US005932828A

United States Patent [19]

Hornady et al.

[11] Patent Number: 5,932,828

[45] **Date of Patent: *Aug. 3, 1999**

[54] RELOADER WITH SNAP-IN TOOLS AND QUICK RELEASE SHELL OR SHOT SHELL HOLDERS

[75] Inventors: Stephen Hornady; Kenneth L. Elshof, both of Grand Island, Nebr.; John W. Goodin, Coto de Caza; Dennis L. Grudt, Long Beach, both of Calif.

[73] Assignee: Hornady Manufacturing Company, Grand Island, Nebr.

[ * ] Notice: This patent issued on a continued prosecution application filed under 37 CFR 1.53(d), and is subject to the twenty year patent term provisions of 35 U.S.C. 154(a)(2).

[21] Appl. No.: 08/756,949

[22] Filed: Dec. 2, 1996

[51] Int. Cl.[6] ..... F42B 33/02; B25G 3/16

[52] U.S. Cl. ..... 86/23; 86/27; 86/28; 403/349

[58] Field of Search ..... 86/44, 23, 25, 86/26, 27, 28, 29, 30, 31, 32, 33, 36, 37, 38, 39, 40, 41; 403/349, 348

[56] References Cited

U.S. PATENT DOCUMENTS

| | | | |
|---|---|---|---|
| 796,220 | 8/1905 | Jones | 403/349 |
| 2,617,166 | 11/1952 | Kaufmann | 403/349 |
| 3,157,086 | 11/1964 | Bachhuber | 86/27 |
| 4,020,737 | 5/1977 | Ranson | 86/23 |
| 4,393,744 | 7/1983 | Lee | 86/25 |
| 4,522,102 | 6/1985 | Pickens | 86/27 |
| 4,526,084 | 7/1985 | David et al. | 86/25 |
| 4,756,638 | 7/1988 | Neyret | 403/349 |
| 4,766,798 | 8/1988 | David et al. | 86/27 |
| 4,917,525 | 4/1990 | Duncan | 403/349 |
| 5,054,362 | 10/1991 | Bachhuber | 86/27 |
| 5,188,399 | 2/1993 | Durina | 403/349 |
| 5,202,529 | 4/1993 | Shields | 86/23 |
| 5,313,869 | 5/1994 | Lee | 86/27 |
| 5,513,622 | 5/1996 | Mussacchia, Sr. | 403/349 |

*Primary Examiner*—Charles T. Jordan
*Assistant Examiner*—Theresa M. Wesson
*Attorney, Agent, or Firm*—Vincent L. Carney

[57] ABSTRACT

To permit operators to change dies quickly and easily and to remove shot shells from any station, inspect them and replace them, bayonet snap in dies may be easily inserted into a tooling section of a reloader and shot shells can be removed from shell plates by pivoting the retainer free.

13 Claims, 9 Drawing Sheets

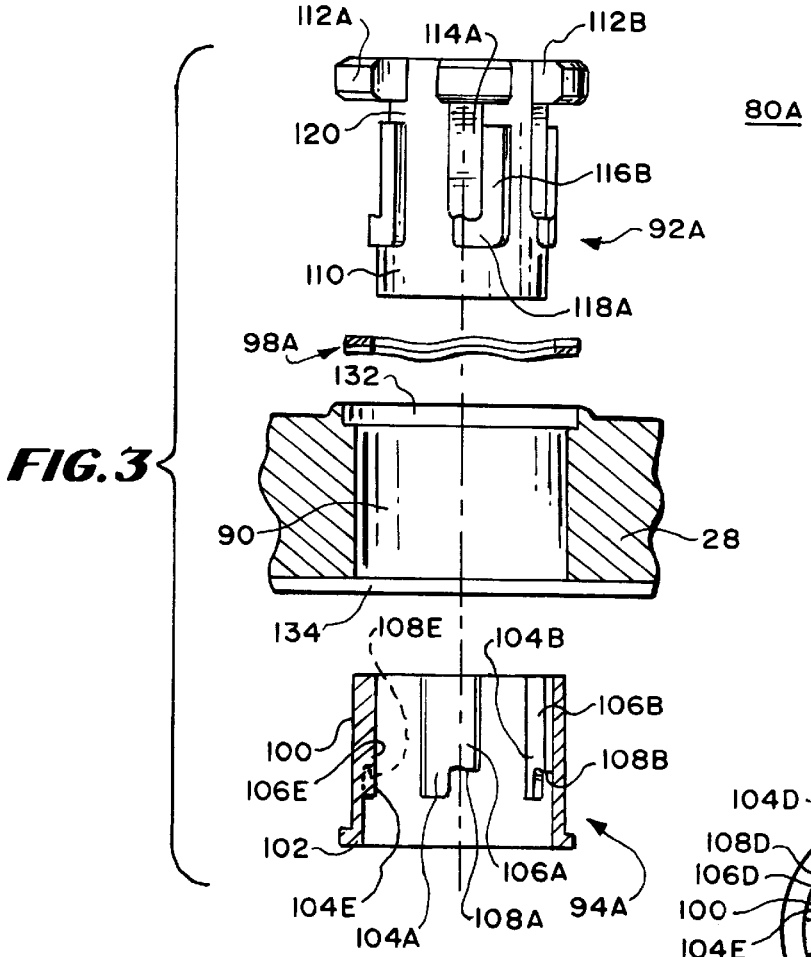
FIG. 3
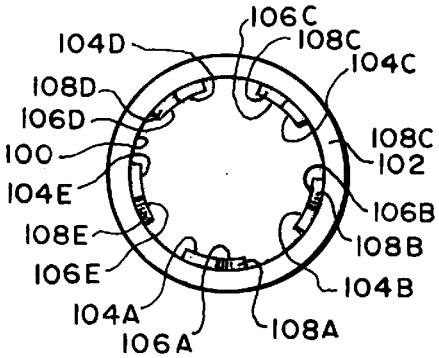
FIG. 4
FIG. 5
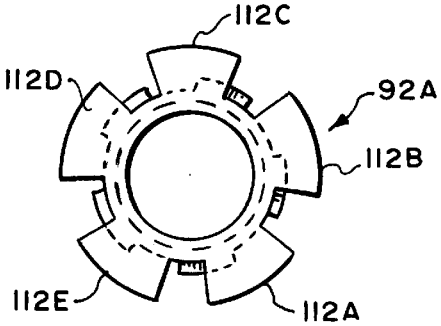
FIG. 6
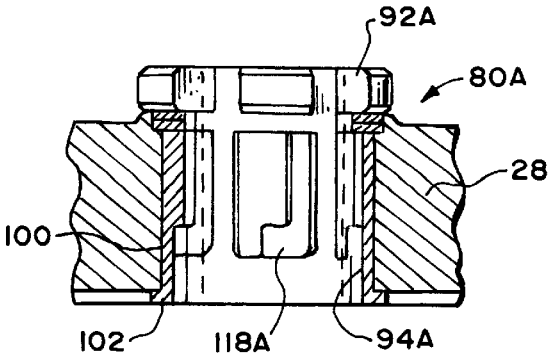

RELOADER WITH SNAP-IN TOOLS AND QUICK RELEASE SHELL OR SHOT SHELL HOLDERS

BACKGROUND OF THE INVENTION

This invention relates to reloaders, and more particularly, to dies and shell or shotshell holders used in reloaders.

In one class of reloader, one or more shell holders mounted to a carriage are adapted to receive a corresponding number of casings. A plurality of tools is mounted opposite the shell holder. The reloaders for shot shells and for cartridges each have such arrangements although the shell holders and dies are different in a shot shell reloader from the shell holder and dies in a cartridge reloader. In a progressive reloader, the shells are moved from station to station while different tools operate on them to reprocess the casings for the shells and reload them. In a single stage reloader, one shell at a time is mounted in a station opposite to a tool holder to perform a loading function at that station and the shells are processed in a plurality of steps by changing tools.

In the prior art carriages for shells, the shells or cartridges are held in place on a shell plate by a retainer or a retainer spring or some other means for holding them securely during the reloading operation.

This type of shell holder has a disadvantage in that it is time consuming and difficult for the operator to remove a shell or cartridge and inspect it at any particular stage, such as for example to detect any difficulties that may have occurred or damage that may have occurred to a shell.

Dies must from time to time be removed and replaced with different dies. This can be a time consuming operation because the dies, particularly the dies for metal casing resizing, must be mounted firmly in place. In the prior art, they are generally threaded into a tool holder and held by a retainer ring that is tightened upon them. The prior art arrangements have a disadvantage because it is time consuming and tedious to change the dies.

SUMMARY OF THE INVENTION

Accordingly, it is an object of the invention to provide a novel reloading apparatus and technique.

It is a further object of the invention to provide a novel die for reloaders.

It is a still further object of the invention to provide a quick release connector to mount dies to a reloader.

It is a still further object of the invention to provide a method for quickly changing dies in a reloader.

It is a still further object of the invention to provide an easy to use shell holder that permits easy removal of the shells.

In accordance with the above and further objects of the invention, a two piece bayonet type tool mount fastens tools to the tool carriage of a shot shell reloader. An inner bayonet male piece holds the tool and enters the tool hole of the carriage from one side and a female socket piece of the two-piece bayonet type holder enters the hole from the other side to lock together. The two-piece mount is thus held firmly in place from the bottom and the top so it can be inserted and removed quickly with ease. In the preferred embodiment, the bayonet piece is the top piece. The bottom female piece may be threaded externally to engage the thread of a tapped hole in the loader for a firmer grip.

A shell holder includes pivotable retaining arms that hold the casings for the shells in place, and are in turn, held in place by another means such as a spring that biases the pivotable retaining arms closed. With this arrangement, during any stage of processing, a casing can be quickly and easily removed by pulling the pivotable retaining arms against the bias of the spring, inspected while free from the holder and then returned to the shell holder by pulling the pivotable retaining arms against the bias of the spring, inserting the shell into the holder and releasing the arms.

As can be understood from the above summary of the invention, the reloader of this invention has several advantages, such as for example: (1) it is relatively easy to insert and remove dies; (2) it is relatively easy to insert and remove shells; (3) it is inexpensive and simple to use.

SUMMARY OF THE DRAWINGS

The above noted and other features of the invention will be better understood from the following detailed description when considered with reference to the accompanying drawings in which:

FIG. 3 is a sectional, exploded view of a quick change bayonet style die mount in accordance with an embodiment of the invention of FIGS. 1 and 2;

FIG. 4 is a plan view of a portion of the die mount of FIG. 3;

FIG. 5 is a plan view of still another portion of the die mount of FIG. 3;

FIG. 6 is a sectional view through the die mount of FIGS. 1–5;

DETAILED DESCRIPTION

Figure 1:
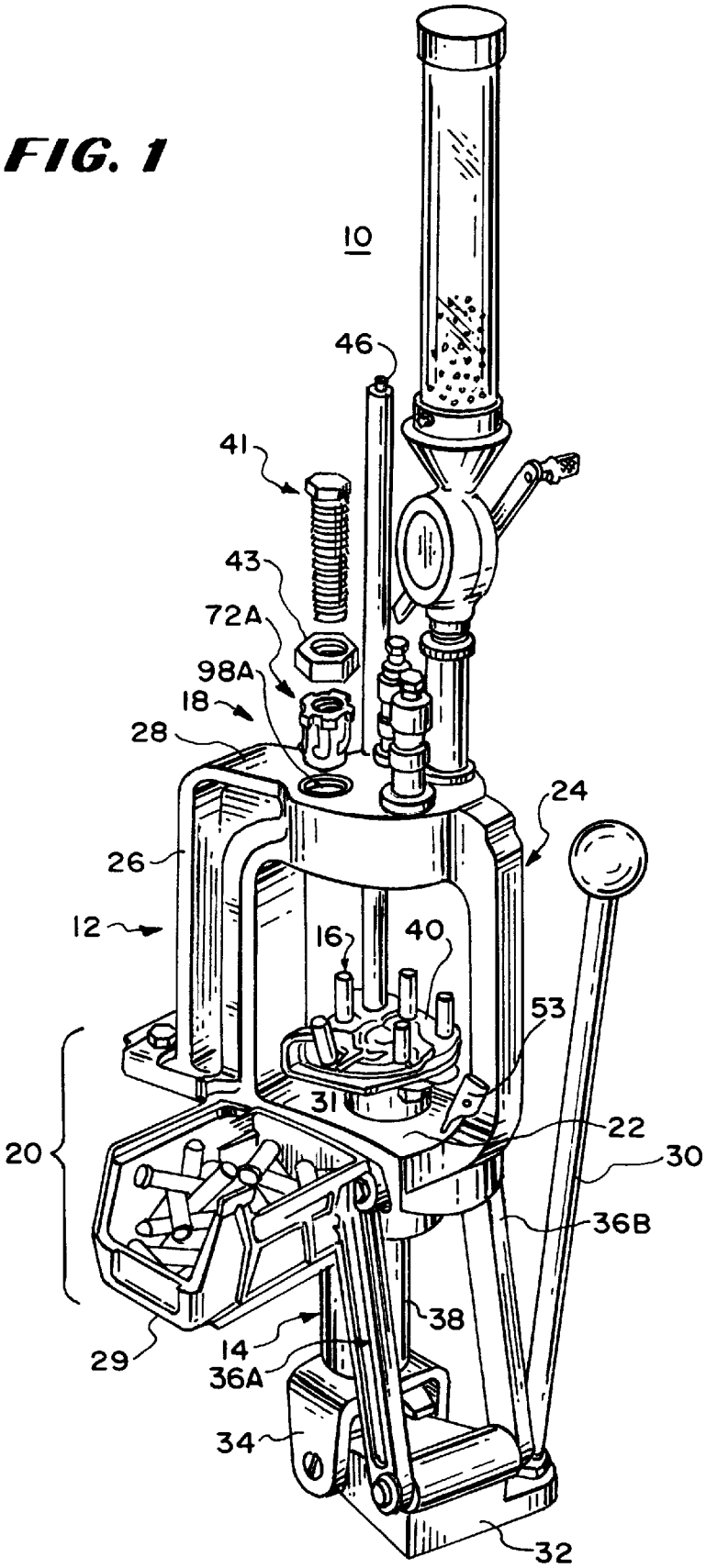
FIG. 1 is a perspective view of a loader in accordance with an embodiment of the invention.

In FIG. 1, there is shown a perspective view of a reloading apparatus 10 having a frame indicated generally at 12, a drive means 14, a turret section 16, a refinishing and loading section 18 and a case ejector assembly 20. The reloading apparatus 10 is a cartridge reloader which is one type of reloader that may incorporate the invention. However, while the preferred embodiment of quick release die mount is intended for metal casing bullet reloaders, the preferred embodiment of quick release shell holder is intended primarily for shot shell reloaders. The type of reloader incorporating the die mount and/or shell holder is not material to the invention.

The frame 12 of the reloader 10 is adapted to be mounted to a work bench or the like and to support in cooperative arrangement: (1) the drive means 14 mounted below the frame 12; (2) the turret section 16 mounted to the drive means 14; (3) the tooling and loading section 18 at the top of the frame 12 to cooperate with the turret section 16; and (4) the case ejector assembly 20 mounted on the frame 12 to cooperate with the turret section 16 and the frame 12. A plurality of metallic shells are mounted on the turret section 16.

To support the other parts of the reloading apparatus 10, the frame 12 is generally formed as a closed square loop having: (1) a base 22; (2) a first upstanding column 24 on one side of the base 22; (3) a second vertical upstanding column 26 on the opposite side of the base 22 parallel to the first column 24; and (4) a top supporting member 28 parallel to the base 22 and adjoining the upper ends of the vertical parallel upstanding columns 24 and 26.

To guide the turret section 16, the base 22 of the frame 12 includes a cylindrical aperture passing through it to receive the top portion of the drive means 14. To support the case ejection assembly 20, the base 22 of the frame 12 includes a flat upper surface and a front vertical wall, with the case ejection assembly 20 generally bridging the turret section 16 and the base 22 to eject cartridges from the turret section 16 and collect them in a manner to be described hereinafter. The drive means 14 is pivotably mounted to a lower collar on the frame.

To mount the reloader to a bench or the like, the second vertical upstanding column 26 has a cross-section of an I-beam and a bottom mounting plate adapted to be clamped or bolted to the work bench. This frame is substantially the same as the frame disclosed in U.S. Pat. No. 4,526,084, granted Jul. 2, 1985, to David et al. and assigned to Hornady Manufacturing Company. The disclosure of the aforementioned patent is incorporated herein by reference to it as part of this disclosure.

To move the turret section 16 between the refinishing and loading section 18 and the base 22, the drive means 14 includes a handle 30, a rocker arm 32, a yoke 34 and a pair of linkage arms 36A and 36B. The handle 30 is connected to the rocker arm 32 which in turn is mounted for movement within the yoke 34 and the linkage arms 36A and 36B.

To lower the turret section 16 when the handle 30 is in a substantially vertical position as shown in FIG. 1, the linkage arms 36A and 36B connect the rocker arm 32 pivotably to the frame 12 and the rocker arm 32 is connected pivotably to the yoke 34. The yoke 34 is connected at its top to the turret section 16. To move the yoke 34 upwardly and thus drive the turret section 16 upwardly, the rocker arm 32 rotates about the linkage arms 36A and 36B when the handle 30 is pulled forward and down to a more horizontal position from that shown in FIG. 1. The drive means 14 is substantially the same as that shown in the aforesaid patent to David et al. and to that used in the Pro-7 Progressive reloaders sold by Hornady Manufacturing Company, Box 1848, Grand Island, Nebr. 68801.

To progressively reload a plurality of shells, the turret section 16 includes a carriage 38, a shell holder 40 and an advancing mechanism (not shown in FIG. 1) for moving the shell holder 40. The shell holder 40 is shown supporting certain shell or cartridge casings in different stages of refinishing and reloading. The carriage 38 is connected to the yoke 34 to be raised and lowered thereby through the frame 12 and supports the shell holder 40, with the advancing mechanism being within the carriage to move the cartridge casings from station to station during the reloading process.

The refinishing and loading section 18 rests upon the top supporting plate 28 and contains the tools to refinish casings, one of which is a sizing tool 41 shown in perspective and exploded in FIG. 1. The tools are each mounted by a quick change bayonet mount to the supporting plate 28. Beneath the top supporting plate 28 is the base 22, supporting: (1) the case ejection assembly 20 to automatically eject cartridges; and (2) an automatic primer to prime the shells. The case ejection assembly 20 includes a cartridge catcher assembly 29, a kicker assembly 31, partly hidden in FIG. 1 and a cam 53.

The sizing tool 41 is mounted to the supporting plate 28 by the top bayonet piece 72A and washer 98A which cooperate with a socket piece of the bayonet mount. The socket piece of the bayonet mount (not shown in FIG. 1) is beneath the supporting plate 28 and engages the top bayonet piece 72A to hold the two together with the retaining ring or washer 98A being compressed between the bayonet piece and the supporting plate 28 when the bayonet piece 72A is snapped within the socket piece of the bayonet mount. The sizing tool 41 has external threads that engage internal threads in the top bayonet piece 72A and has a retaining nut 43 which holds the sizing die to the bayonet mount. The other tools are mounted in a similar manner.

The turret section 16 includes a shell plate 40 having a plurality of case recepticals (FIG. 10 and FIG. 14) and case retainers. The case retainers are biased closed but may be easily opened to remove a case and inspect it. For this purpose, the case retainers include biased pivotable fingers to hold the recepticals closed but enable easy movement to manually open them to remove the case or to replace the case.

Figure 2:
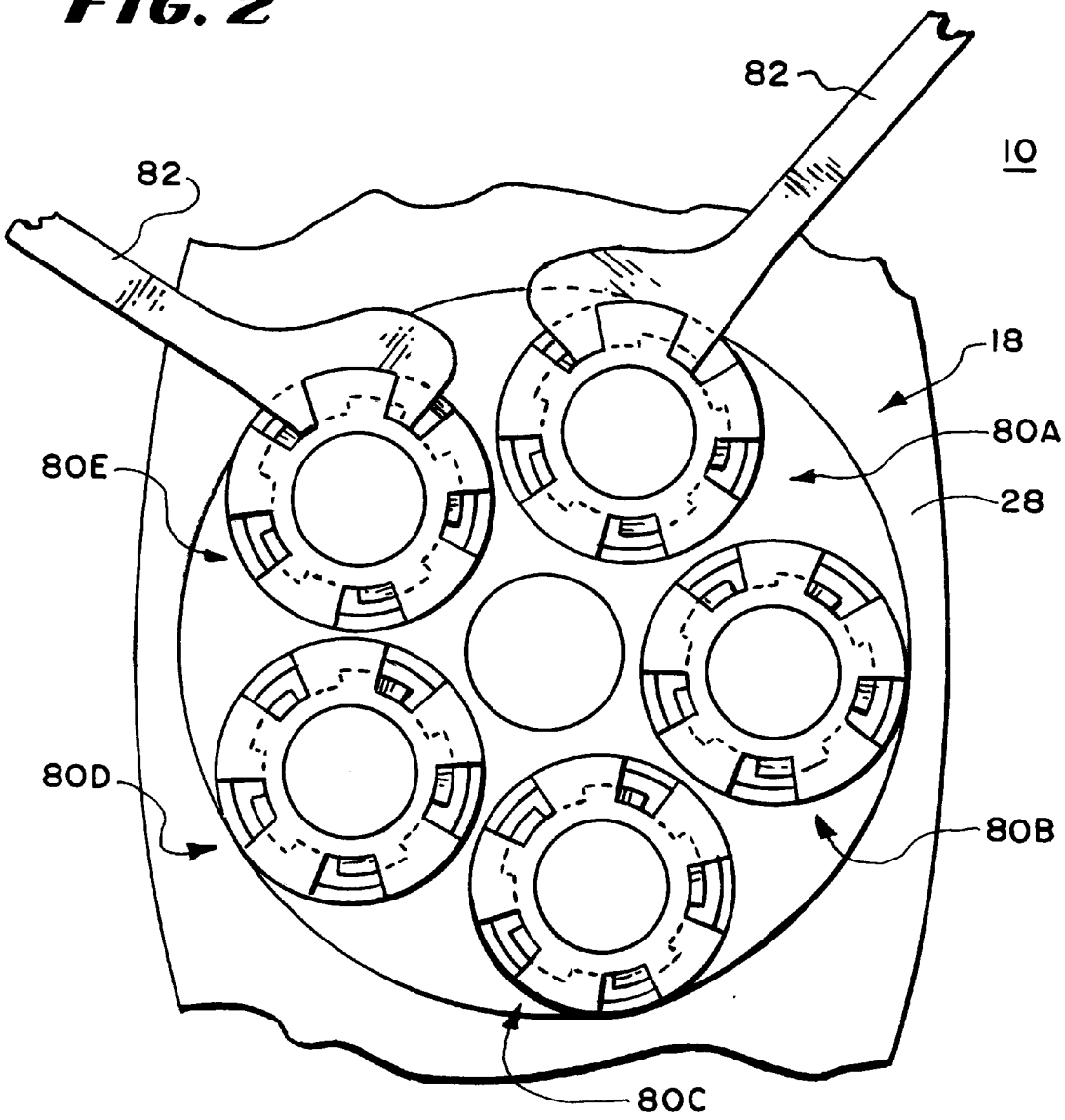
FIG. 2 is a plan view of a tooling section for the loader of FIG. 1 which may accommodate an embodiment of the invention.

In FIG. 2, there is shown a fragmentary top view of the reloading apparatus 10, showing the refinishing and loading section 18. A plurality of die mounts 80A–80E are mounted at circumferentially spaced locations to holes in the top supporting member 28 so that as the carriage 38 (FIG. 1) moves the shell support between the base 22 and the top supporting member 28, the shells mounted thereon may be progressively acted upon, with each shell being moved one station at each operation to progressively perform the next operation on the next of the shells mounted within the shell holder 40 (FIG. 1).

The different stations are mounted to the top of the top supporting member 28 to cooperate with the shells in the shell holder 40 (FIG. 1) and may for example include a sizing and depriming tool, a neck expanding tool, a powder charge supply station to supply powder after the shell has been formed, a bullet serrating and/or crimping tool and a taper crimping tool in the case of pistol bullets, each tool being mounted to a different one of the die mounts 80A–80E. Beneath the top supporting member 28 (FIG. 1), there is a base 22 to mount the reloading apparatus 10 to an appropriate work bench.

The snap-on bayonet mount may be used on any tool mounting station and it may be used on other types of equipment besides that shown in FIG. 2. The use of such tool station or stations is conventional and known in the art and other arrangements are known and may be used instead of the arrangement shown in FIG. 2. Moreover, a single tool may be mounted in a single stage reloader for one step in the processing of a plurality of shells and then changed for the next step. In FIG. 2, a single stamped metal wrench 82 is shown in either of its two positions for mounting or removing a tool.

In FIG. 3, there is shown a sectional exploded view of a quick-change bayonet style die mount 80A having a top bayonet piece 92A, a bottom socket piece 94A, and a washer 98A. As shown in this view, the bottom socket piece 94A fits into an opening 190 in the top supporting member 28 where it is engaged by the top bayonet piece 92A. The top bayonet piece 92A snaps in place within the bottom socket portion 94A and is locked therein by twisting so that the top and bottom pieces are mounted securely to the top supporting member 28. The wave washer retaining ring 98A fits between the upper portion of the top bayonet portion 92A and the top supporting member 28. With this arrangement, a die may be mounted to extend through the opening 190 in the top supporting member 28 to engage casings below during operation of the reloader. In the preferred embodiment, the dies include external threads to engage internal threads in the top bayonet piece 92A for mounting thereto.

To receive the bottom socket piece 94A and the top bayonet piece 92A of the die mount 80A, the hole 190 extends through the horizontal top flat supporting member 28 and thus has a vertical longitudinal axis through the socket and bayonet. At the upper portion of the hole 190 there is a counterbore 132 within the supporting plate 28 and at the bottom portion of the hole 190 there is another counterbore 134.

To mount to the top bayonet piece 92A within the hole 190 of the supporting member 28, the bottom socket piece 94A of the quick-change bayonet mount 80A includes a tubular outer wall 100, an outwardly extending bottom flange 102, five longitudinal radially-inwardly vertically-downwardly extending stems 104A–104E (104A and 104B being shown in FIG. 3), five corresponding radially-inwardly circumferentially-extending detents 106A–106E (106A and 106B being shown in FIG. 3) and five corresponding hook or latch members 108A–108E (108A and 108B being shown in FIG. 3). The downwardly extending stems 104A–104E are circumferentially spaced apart from each other and extend downwardly from the top of the tubular wall 100 to engage locking members of the upper bayonet piece 92A. The engaging edges are more than half way down the axis of the tubular wall and form an inwardly extending detent 106A into which a corresponding latch or hook member from the upper bayonet portion 92A may fit to prevent upward or counter-clockwise movement of the top bayonet piece 92A with respect to the bottom socket piece 94A of the mount 80A.

The radially outwardly extending bottom flange 102 fits within the bottom counterbore 134 of the top supporting member 28 to provide a flush bottom surface and resist upward movement of the die mount and the wave washer retaining ring 98A fits within the counterbore 132 and resists movement in a clockwise or counter-clockwise direction when the two pieces of the bayonet type mount are snapped together. The dimensions of the two pieces, the counterbores and the washer are such as to tightly compress them when the bayonet members are locked in place with the detent of the upper piece 92A fitting within the locking surfaces of the bottom piece 94A.

To mount to the bottom socket piece 94A within the opening 190, the top bayonet member 92A includes a cylindrical tubular wall 110, five radially outwardly extending flange members 112A–112E (112A and 112B being shown in FIG. 3), five flattened portions 114A–114E (114A being shown in FIG. 3) circumferentially spacing the radially outwardly extending flange members 112A–112E, a plurality of downwardly extending stems 116A–116E (116B being shown in FIG. 3) ending in a corresponding plurality of hook members 118A–118E (118A being shown in FIG. 3) and an angular groove 120 separating the flange members 112A–112E from the tubular wall 110. The tubular wall 110 has an outer diameter that closely fits within the central opening of the tubular bottom piece 94A and an upward flange that compresses the Smalley wave washer retaining rings 98A downwardly in the counterbore 132 with the upward surface of the latch or hook members 118A–118E being circumferentially spaced and fitting beneath and against the surfaces 108A–108E of the detent members 106A–106E of the bottom piece 94A.

In FIG. 4, there is shown a bottom view of the bottom piece 94A showing the flange 102 and tubular wall 100 with the hook or latch members 108A–108E and stems 104A–104E circumferentially spaced from each other. In the preferred embodiment, the outer diameter of the tubular wall 100 is 1.147 inches. However, other diameters may be used and the detents may take other forms known in the art. Generally, instead of a horizontal circumferential hooking member, the stem may be terminated to mate with a detent not having a stem in the top portion and the socket portion may be held by internal threads in the hole 190 as best shown in FIG. 7.

In FIG. 5, there is shown a top view of the top bayonet member 92A showing the outwardly extending flange portions 112A–112E circumferentially spaced by the cut away flat portions 114A–114E connected to serve as a lining means for the stems and hooks 116A–116E and 118A–118E. In the preferred embodiment, the flange members 112A–112E are 0.125 inches in depth and the tubular wall 110 (FIG. 3) is 1.150 inches in depth. The width of detent portions extends 11 degrees around the circumference and are separated by flat portions 49 degrees. The flange members 112A–112E have an outer diameter of 1.365 inches.

In FIG. 6, there is shown a sectional view of the quick change die mount 80A assembled to the support member 28 illustrating the internal threads of the top bayonet portion 92A that may be used to mount an externally threaded die to the upper bayonet portion 92A and the manner in which the portion 92A locks the hook or latch member 118A beneath the detent 106A of the bottom portion 94A to lock the bayonet portions together. In the embodiment of FIG. 6, the hook and detent members hold the two parts together quickly and easily. Flat portions 112A–112E on the outer flange of the bayonet portion 92A permit easy grasping by a wrench for loosening and tightening the bayonet portion with the tool. Thus, a die may be threaded into the top bayonet portion 92A and snapped in place with the bayonet portion fitting within the bottom socket portion 94A and the two locked together, or in the alternative, the quick release mount may be mounted in place and a die threaded and locked thereto in a manner similar to the previous connection of dies to a loader but permitting quick removal of the die for checking.

Figure 7:
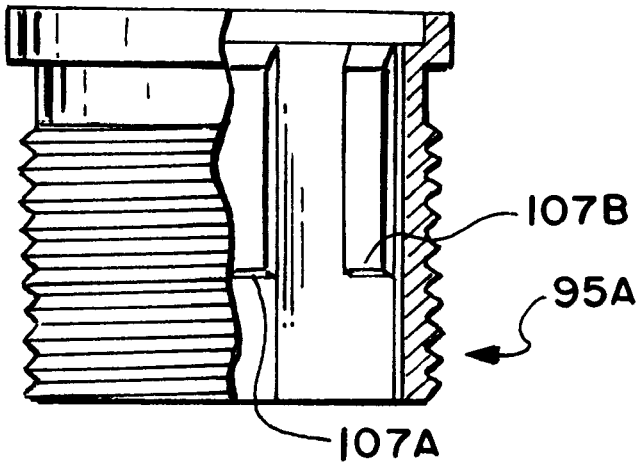
FIG. 7 is an elevational view, partly broken away, of the female socket portion of another embodiment of die mount.

In FIG. 7, there is shown an elevational view of another embodiment of a bottom portion or socket 95A of the bayonet die mount 80A. In this embodiment, external threads are provided to permit the socket 95A to be threaded into a conventional loader. As shown in the broken away portion, the detent is a single, downwardly-extending rib or stem rather than the rectangular notch of the embodiment of FIGS. 3 and 6 to receive a hook or latch 119A (FIG. 8).

Figure 8:
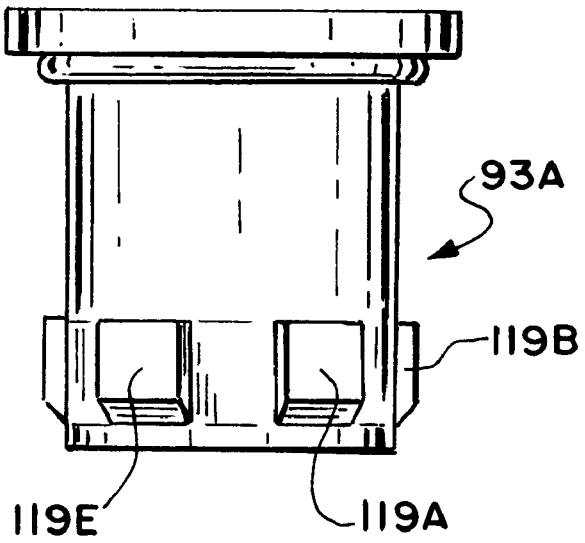
FIG. 8 in an elevational view of the male portion of the embodiment of die mount of FIG. 7.

In FIG. 8, there is shown another embodiment of a top bayonet member 93A which matches the bayonet member 92A in the embodiment of FIG. 3 except that instead of a hook 118A to engage the rectangular notch 106A serving as a detent, the bayonet member 93A includes a single parallelopiped shaped radially extending latch 119A to slide beneath and engage a detent 107A of the bottom socket 95A. Similarly, there are four other latches 119B–119E in the bayonet member 93A (119A, 119B and 119E being shown in FIG. 8), each of which engages a corresponding one of four other detents 107B–107E of the socket 95A (107A and 107B being shown in FIG. 7) to operate in the same manner as the mount of FIG. 3. Also in the embodiments of FIGS. 7 and 8, the outward flange is not circumferentially spaced by flat portions but does have wrench flats cut into it.

Figure 9:
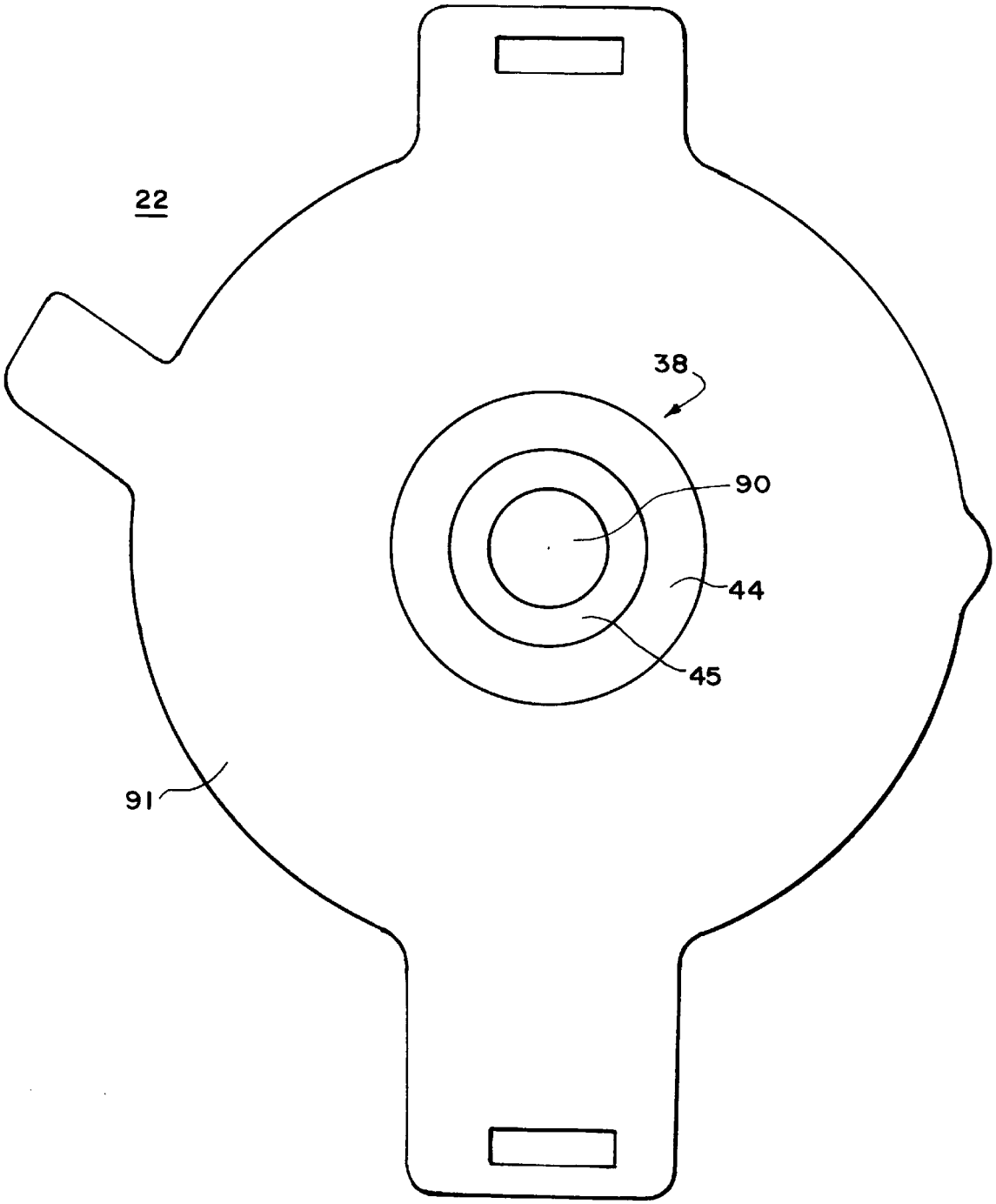
FIG. 9 is a plan view of a shot shell loader platen in accordance with an embodiment of the invention.

In FIG. 9, there is shown a simplified plan view of a base or platen 22 including a flat support 91 and a carriage 38. The carriage 38 is at the center of the support member 91 and includes three sections, a drive shaft 90, a stationary cylinder 45 and a rotatable column 44. The drive shaft 90 controls the position of the support member 91 and movement of the carriage 38. The cylinder 45 remains stationary with respect to the flat support member 91 and is adapted to have mounted to it a case release cam to be described in connection with FIG. 13 and the rotatable column 44 carries the shell plate 40 (FIG. 1) and rotates it circumferentially with respect to the stationary cylinder 45.

Figure 10:
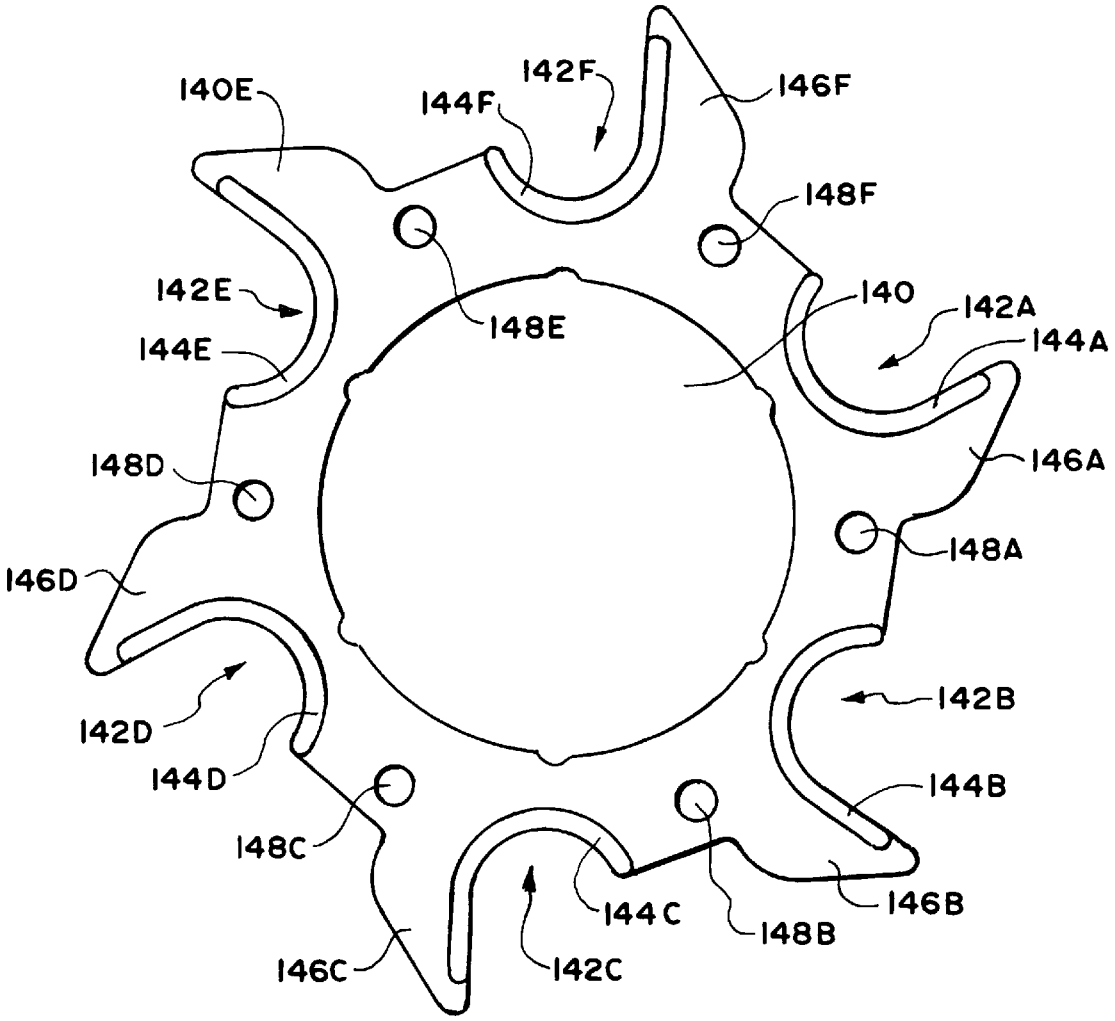
FIG. 10 is a shell plate usable in a loader in accordance with an embodiment of the invention.
Figure 14:
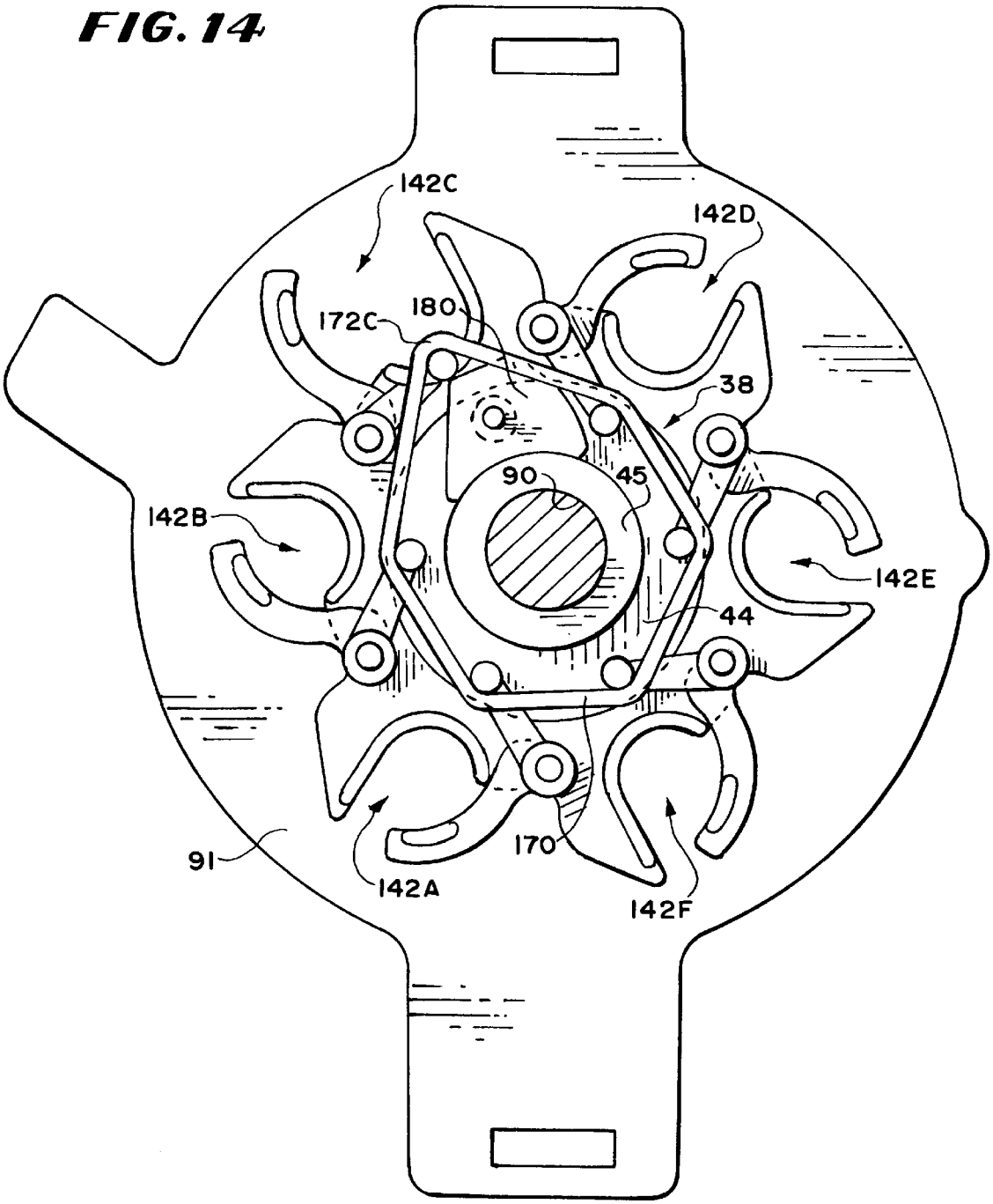
FIG. 14 is a plan view of a shell holder in accordance with an embodiment of the invention.

In FIG. 10, there is shown a plan view of a shell plate 40 adapted to be mounted to the rotatable column 44 (FIG. 9) for movement therewith in a manner to be described more fully in connection with FIG. 14. The shell plate 40 includes a central opening 140, six case receptacles, 142A–142F and a corresponding six pivot openings 148A–148F. Each of the case receptacles 142A–142F includes as its component parts a corresponding one of the curved contact portions 144A–144F and arm portions 146A–146F. The receptacles 142A–142F are spaced circumferentially from each other about the central opening 140 so that the central opening 140 fits around the rotatable column 44 (FIG. 9) for movement therewith and carries in a circular path the circumferentially spaced receptacles 142A–142F.

The contact portions 144A–144F are each mounted as a part of the receptacle opening to receive the shot shell cartridges and carry them with the shell plate in a circular path from station to station while the casings are reworked and filled with powder and shot in a manner known in the reloader art. The arm portions 146A–146F extend radially outwardly to form a partial enclosure for the cases and thus hold the cases in position when case retainers to be described hereinafter close the receptacles. The openings 148A–148F are adapted to receive these case retainers which pivot about with them as pivot points. For this purpose, the pivot openings 148A–148F are circumferentially spaced from each other, intermediate the receptacles 142A–142F with each of the pivot openings 148A–148F being mounted in juxtaposition with a corresponding one of the receptacles 142A–142F.

Figure 11:
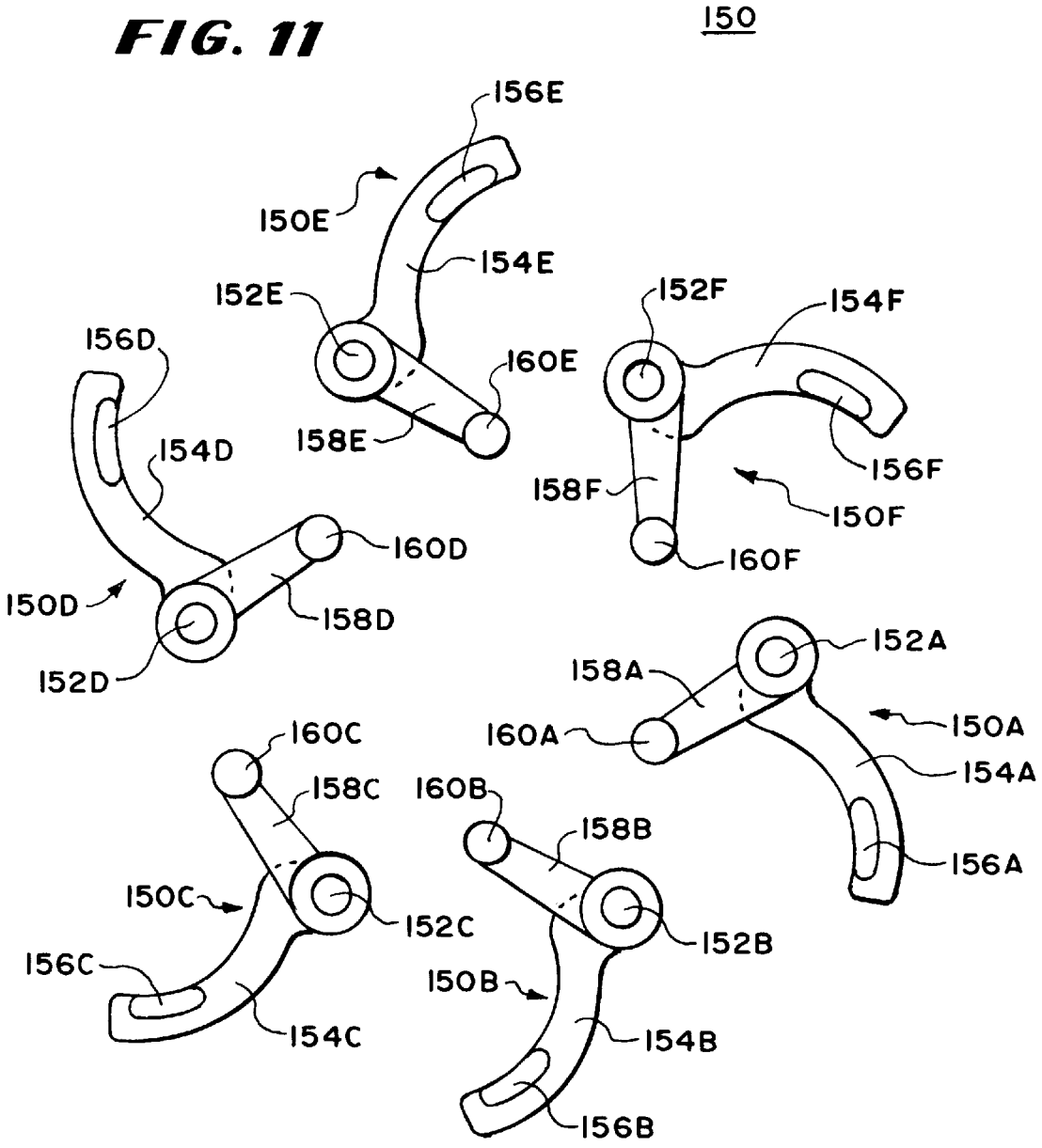
FIG. 11 is a simplified plan view of an arrangement of case retainers in accordance with an embodiment of the invention.

In FIG. 11, there is shown an array 150 of case retainers, 150A–150F, arranged as they would be positioned with respect to the shell plate 40, each having a corresponding one of pivot points 152A–152F which fits within a corresponding one of the openings 148A–148F (FIG. 10) of the shell plate 40 to cooperate with a corresponding one of the receptacles 142A–142F (FIG. 10) of the shell plate 40.

Each case retainer, such as for example the case retainer 150A, is identical to the others and includes in addition to a corresponding one of the pivot pins 152A–152F, a corresponding one of case fingers 154A–154F and a corresponding one of spring arms 158A–158F. The corresponding ones of the case fingers and spring arms are mounted together to pivot about the corresponding pivot point so that movement of a spring arm moves its corresponding finger grip. Since each of the case retainers 150A–150F are identical, the case retainer 150A will be described in detail.

As shown in FIG. 11, the case finger 154A includes a finger grip 156A mounted near its end to permit manual movement thereof to pull it free from a case so that the case may be inspected. It is connected at the pivot pin 152A to the spring arm 158A. The spring arm 158A is a relatively straight elongated member. At the end of the spring arm 158A is a spring post 160A which receives a spring that biases the curved portion of the corresponding case finger 154A against a case held within a corresponding receptacle 142A (FIG. 10) of the shell plate 40. With this arrangement, each of the case retainers 150A–150F includes a case finger 154A–154F that holds a case in place except when pulled against the bias of the spring by the finger grip (156A–156F) to release the case or when the case plate carries its receptacle to a location for ejection or removal of the shell under the control of a case release cam mounted to the stationary cylinder 45 (FIG. 9) as will be described hereinafter.

Figure 12:
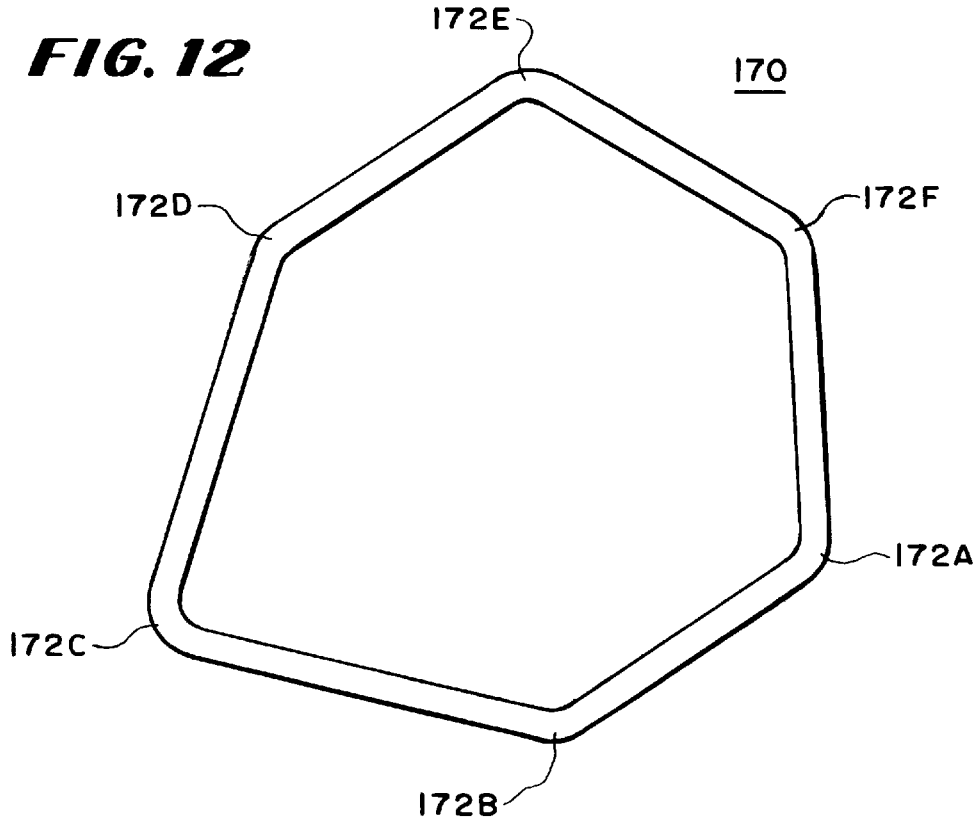
FIG. 12 is a plan view of a case retainer spring usable in a shot shell mount in accordance with an embodiment of the invention.

In FIG. 12, there is shown a plan view of a case retainer spring 170 forming a closed hexagonal shaped loop having six apexes or sharp corners 172A–172F, each adapted to engage a corresponding one of the posts 160A–160F (FIG. 11), with the post being within the loop 170. The case retainer spring is of wire and is flexible so that any of the posts may move it when its corresponding finger grip 156A–156F is pulled to release a shell for inspection. Four of the sides of the hexagon loop 170 are equal and two are longer, resulting in the apex 172C extending further from the center of the hexagon than the other apexes 172A, 172B, 172D, 172E and 172F. The apex 172C is positioned at the station for ejecting or removing shells and for inserting new cases.

Figure 13:
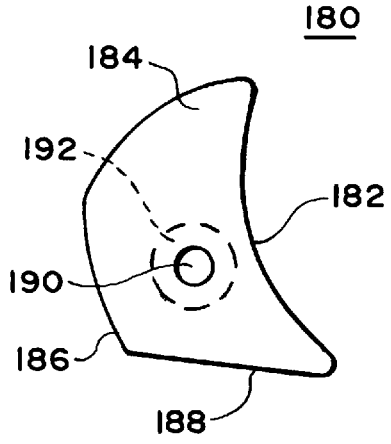
FIG. 13 is a plan view of a case release cam for a shell holder in accordance with an embodiment of the invention.

In FIG. 13, there is shown a plan view of a case release cam 180 having four edges 182–188 and a flat top and bottom sides with an opening 190 passing between the top and bottom side to hold a spacer 192 on the bottom side. The spacer 192 slides with respect to the rotatable column 44 (FIG. 9) and the curved edge 182 is adhered fixedly to the stationary cylinder 45 (FIG. 9) so that the case release cam is stationary with respect to the support surface 91 (FIG. 9) of the platen 22 and the case retainer spring 170 (FIG. 12). With this arrangement, the shell plate and case retainers orbit about it. The edges 184, 186 and 188 serve as cam surfaces for the spring posts 160A–160F to force them to move radially outwardly against the spring bias at the ejection station and permit ejection or replacement or addition of a casing at the apex 172C of the case retainer spring 170 (FIG. 12).

In FIG. 14, there is shown a plan view of the platen 22 of FIG. 9, the shell plate 40 of FIG. 10, the case retainers 150A–150F of FIG. 11, the case retainer spring 170 of FIG. 12 and the case release cam 180 of FIG. 13 mounted together in operating position. In operation, shells are held within the receptacles 142A–142F and moved together with the rotatable column 44 and the shell plate 40 while being held in their corresponding receptacles by corresponding ones of the case retainers 150A–150F.

However, when the case retainer posts 160A–160F reach the apex 172C of the case retainer spring 170, the corresponding one of the case retainer posts 160A–160F are moved radially outwardly along the edge 184, pivoting the case retainer about its corresponding pivot point 152A–152F to open the corresponding receptacle and permit ejection or removal of a shell or insertion of a new case for a shell. At each of the stations, operations are performed on the shell in a manner known in the reloader art. While in the preferred embodiment, the shell carrier is designed for shot shell reloading, a similar mechanism, although probably with only five receptacles, can be used for bullet shell reloading and any other suitable type of reloading or other operation.

As can be understood from the above description, the die holder of this invention has several advantages, such as for example: (1) it permits fast and easy removal of dies or other tools; and (2) it avoids wear and tear on die mounts. The shell carrier of this invention also has several advantages such as for example: (1) it is relatively easy to remove a shell and inspect it by pulling on the hand grip of the shell retainer finger; and (2) there is less chance of complications when removing the shell such as a retainer spring that comes loose when being stretched since the retainer spring is on the inside of the carrier and may not be touched by the user.

While a preferred embodiment of the invention has been described with some particularity, many modifications and variations in the preferred embodiment are possible within the light of the above teachings. Therefore, it is to be understood that, within the scope of the apended claims, the invention may be practiced other than specifically described.

What is claimed is:

1. A method of mounting tools of a reloader to the reloader, comprising the steps of:

mounting a tool to a first coupling member of first and second coupling members forming a tool mount;

mounting the second coupling member to said reloader; and fastening the second coupling member to the first coupling member, wherein the first and second coupling members mount the tool to the reloader;

said step of fastening the second coupling member to the first coupling member comprising the steps of positioning a first locking member on said first coupling member and a second locking member on said second coupling member with respect to each other to permit one of the first and second coupling members to be moved into the other of said first and second coupling members; moving said one of said first and second coupling members into the other of said first and second coupling members and engaging said first and second locking members, wherein said first and second locking members hold said tool securely on said reloader; using said reloader removing said tool by disengaging said first and second locking members and withdrawing said one coupling member from said other coupling member.

2. A method according to claim 1 in which the step of mounting a tool to a first coupling member comprises the step of screwing a threaded portion of the tool and a first threaded portion of the first coupling member together and the step of mounting said second coupling member to said reloader comprises the step of screwing a second threaded portion of said second coupling member and a threaded portion of said reloader together.

3. A reloader comprising;

a shell carriage;

said shell carriage being movable and containing means for holding shells, wherein the shells may be moved from station to station;

said means for holding shells including openings for said shells;

retaining means for holding the shells in place as the shells are moved from station to station;

means for opening the retaining means at a station;

spring means for biasing said retaining means closed; and said spring means for biasing being mounted at a location spaced away from said openings in said means for holding shells.

4. A reloader in accordance with claim 3 in which said shell carriage includes means for moving said shells in a circular path and said spring means for biasing is a closed loop.

5. A reloader in accordance with claim 3 in which said retaining means includes a plurality of pivotable members and said spring means biases said pivotable members about a pivot point into a closed position.

6. A reloader in accordance with claim 3 in which said retaining means include first and second arms mounted to a pivot means;

said first arm closing said means for holding shells whereby said means for holding shells is in a closed position;

said second arm being positioned to move said first arm; and said spring means biasing said second arm in a direction that closes said openings.

7. A reloader in accordance with claim 6 further including cam means for moving said second arm into a position in which said first arm moves away from said closed position to release said shell.

8. A reloader in accordance with claim 3 further including:

a tool mount having a first member and a second member;

said second member being adapted to receive a tool for a reloader;

said first member being adapted to be positioned in juxtaposition with a support plate of a reloader; and fastener means for permitting easy connection of the first member to the second member.

9. A reloader in accordance with claim 8 in which said first and second members have aligned central openings and said fastener means connects the first member to the second member with the longitudinal axis of said central openings aligned.

10. A reloader in accordance with claim 8 in which said first member fits within said second member.

11. A reloader in accordance with claim 10 in which said first member threads within an opening of said reloader.

12. A reloader in accordance with claim 8 in which said second member is tubular and fits within said first member, said second member having internal threads adapted to receive external threads of the tool for a reloader.

13. A reloader in accordance with claim 8 in which:

said second member fits within said first member and said fastener means includes an inwardly extending abutment having a first engaging surface;

said abutment extending radially inwardly;

said second member includes an abutment having an engaging surface adapted to mate with the engaging surface of the abutment of said fastener means; and said abutment of the second member extending radially outwardly from said second member, wherein said first and second members are capable of locking together when said first and second members are rotated with respect to each other.

* * * * *